US011536447B2

(12) United States Patent
Manenti

(10) Patent No.: US 11,536,447 B2
(45) Date of Patent: Dec. 27, 2022

(54) VAPOUR AND LIQUID DRUM FOR A SHELL-AND-TUBE HEAT EXCHANGER

(71) Applicant: ALFA LAVAL OLMI S.P.A, Suisio (IT)

(72) Inventor: Giovanni Manenti, Castelli Calepio (IT)

(73) Assignee: ALFA LAVAL OLMI S.P.A., Suisio (IT)

( * ) Notice: Subject to any disclaimer, the term of this patent is extended or adjusted under 35 U.S.C. 154(b) by 263 days.

(21) Appl. No.: 16/616,215

(22) PCT Filed: Apr. 26, 2018

(86) PCT No.: PCT/EP2018/060726
§ 371 (c)(1),
(2) Date: Nov. 22, 2019

(87) PCT Pub. No.: WO2018/215161
PCT Pub. Date: Nov. 29, 2018

(65) Prior Publication Data

US 2020/0096191 A1 Mar. 26, 2020

(30) Foreign Application Priority Data

May 26, 2017 (EP) ..... 17425054

(51) Int. Cl.
*F22B 21/30* (2006.01)
*F22B 1/18* (2006.01)
(Continued)

(52) U.S. Cl.
CPC ..... *F22B 21/30* (2013.01); *F22B 1/1884* (2013.01); *F22B 21/005* (2013.01); *F22B 21/002* (2013.01); *F28D 7/06* (2013.01)

(58) Field of Classification Search
CPC .... F22B 1/1884; F22B 21/002; F22B 21/005; F22B 21/30; F28D 7/06
(Continued)

(56) References Cited

U.S. PATENT DOCUMENTS 2,372,992 A 4/1945 Wallis et al.
2,373,564 A * 4/1945 Huff ..... F22B 1/1869 122/34

(Continued)

FOREIGN PATENT DOCUMENTS

GB 1194680 A 6/1970
RU 1 351 338 A1 9/2006

(Continued)

OTHER PUBLICATIONS

An English Translation of the First Office Action dated Sep. 22, 2020, by the National Intellectual Property Administration, P. R. China in corresponding Chinese Patent Application No. 201880034556.9. (10 pages).

(Continued)

*Primary Examiner* — Steven B McAllister
*Assistant Examiner* — Benjamin W Johnson
(74) *Attorney, Agent, or Firm* — Buchanan Ingersoll & Rooney PC

(57) ABSTRACT

A shell-and-tube heat exchanger comprises a shell enclosing a plurality of U-shaped tubes. Each tube is provided with a first portion and with a second portion. The open ends of each tube are connected to a tube-sheet. A pressure chamber is connected to the tube-sheet. The pressure chamber contains a guiding jacket that, at a first end thereof, is sealingly joined to the tube-sheet or the first tube portions and, at a second end thereof that is opposite to the first end, is open. The guiding jacket splits the pressure chamber into a first section and a second section. The first section and the second (Continued)

section are in communication with each other by means of the open end of the guiding jacket. The first section is provided with a liquid level, located below the open end, and therefore with a vapour chamber, located above the liquid level.

19 Claims, 1 Drawing Sheet

(51) Int. Cl.
*F22B 21/00* (2006.01)
*F28D 7/06* (2006.01)

(58) Field of Classification Search
USPC ..... 122/7 R
See application file for complete search history.

(56) References Cited

U.S. PATENT DOCUMENTS

| | | | |
|---|---|---|---|
| 2,402,154 | A | 6/1946 | Fletcher |
| 2,420,655 | A | 5/1947 | Coykendall et al. |
| 2,550,066 | A | 4/1951 | Hardgrove |
| 2,552,505 | A | 5/1951 | Patterson |
| 2,800,307 | A | 7/1957 | Putney |
| 2,806,453 | A | 9/1957 | Troutman |
| 2,815,007 | A | 12/1957 | Sprague et al. |
| 3,114,353 | A | 12/1963 | Sprague |
| 3,267,907 | A | 8/1966 | Glausser et al. |
| 3,325,374 | A | 6/1967 | Margen |
| 3,435,596 | A | 4/1969 | Coulter et al. |
| 3,749,160 | A | 7/1973 | Vestre |
| 4,142,580 | A | 3/1979 | Bailey |
| 4,204,502 | A | 5/1980 | Forestier et al. |
| 4,220,200 | A | 9/1980 | Weber |
| 4,548,257 | A | 10/1985 | Williamson |
| 4,561,496 | A | 12/1985 | Kehrer |
| 4,565,554 | A | 1/1986 | Zipay et al. |
| 4,967,699 | A | 11/1990 | Hannerz |
| 5,061,304 | A | 10/1991 | Gorzegno et al. |
| 5,915,465 | A | 6/1999 | Fix et al. |
| 9,227,844 | B2 | 1/2016 | Han et al. |
| 2008/0121383 | A1 | 5/2008 | Birk |
| 2009/0010821 | A1 | 1/2009 | Lehr |
| 2012/0277327 | A1 | 11/2012 | Han et al. |
| 2016/0097375 | A1 | 4/2016 | Zanardi |
| 2016/0161106 | A1 * | 6/2016 | Filippi ..... F22B 1/1884 122/7 R |

FOREIGN PATENT DOCUMENTS

| | | | | |
|---|---|---|---|---|
| RU | 2 334 187 | C1 | 9/2008 | |
| SU | 258322 | A1 | 12/1969 | |
| WO | 2011093163 | A1 | 8/2011 | |
| WO | WO-2011093163 | A1 * | 8/2011 | ..... F22B 1/18 |

OTHER PUBLICATIONS

International Search Report (PCT/ISA/210) dated Aug. 27, 2018, by the European Patent Office as the International Searching Authority for International Application No. PCT/EP2018/060726.

Written Opinion (PCT/ISA/237) dated Aug. 27, 2018, by the European Patent Office as the International Searching Authority for International Application No. PCT/EP2018/060726.

An English Translation of the Office Action (Decision to Grant) and Search Report dated Apr. 21, 2020, by the Federal Service for Intellectual Property in corresponding Russian Patent Application No. 2019143681/12(084626). (8 pages).

* cited by examiner

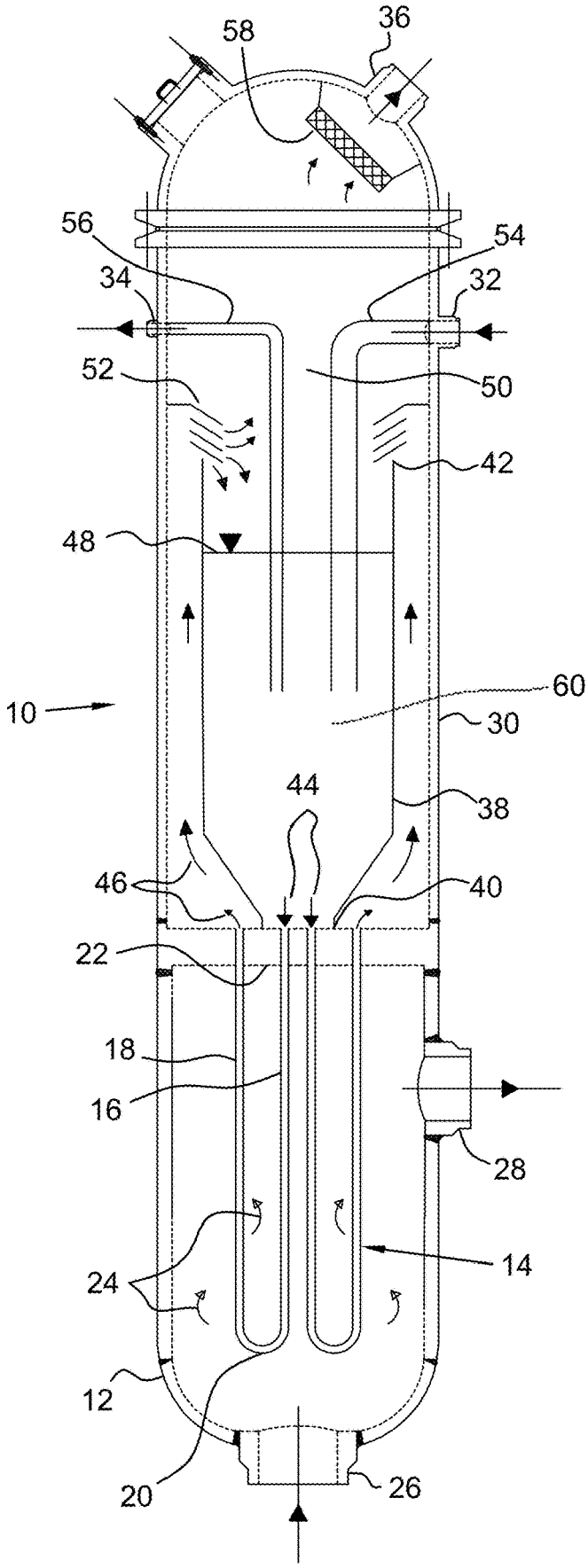
58
36
56
54
34
32
52
50
42
48
60
10
30
44
38
46
40
22
18
16
28
24
14
12
20
26

VAPOUR AND LIQUID DRUM FOR A SHELL-AND-TUBE HEAT EXCHANGER

BACKGROUND OF THE INVENTION

The present invention refers to a shell-and-tube heat exchanger and, more specifically, to a shell-and-tube heat exchanger having a vapour and liquid drum operating under natural circulation.

Hot fluids in power and process industry are often cooled by means of heat exchangers where vaporization of a cooling fluid occurs by indirect heat transfer between the hot and cold fluids. Vaporization allows installing high overall heat transfer coefficients and, consequently, reducing heat transfer surface and operating metal temperatures. Major examples of such heat exchangers are waste heat boilers, or process gas boilers, where a gas at high temperature is cooled by vaporization of water.

When a heat exchanger is used to indirectly cool a hot fluid by means of vaporization of a cooling fluid, for safe and stable operations it is usually necessary to provide for:

- a continuous circulation of the cooling fluid across the heat exchanger;
- a separation of the produced vapour from the liquid;
- a retention volume of the cooling fluid, in liquid state, in case of emergency shut-down.

Circulation of the cooling fluid across the heat exchanger is necessary for avoiding vapour blanketing, reduction of heat transfer performance and possible overheating. The circulation of the cooling fluid can be done by natural or forced draft. The vapour and liquid separation is normally necessary for next operations. The vapour can be used for process or utility purposes, whereas the liquid is often reinjected into the heat exchanger. Finally, the retention volume of the cooling fluid, in liquid state, is generally necessary for assuring a good wetting of exchanging hot surfaces during an emergency shut-down where a lack of coolant occurs.

In order to provide for the circulation of the cooling fluid, for the separation of vapour and liquid phases, as well as for having a retention volume, a vapour and liquid drum is usually installed along with the heat exchanger. Such drum can be either internal or external to the heat exchanger body. In case the drum is external to the heat exchanger body, it is a separated pressure chamber. The drum is therefore connected to the heat exchanger either by means of piping coming to/from the heat exchanger or by means of openings across pressure walls common to the heat exchanger and the drum.

A vapour and liquid drum separated from the heat exchanger body is essentially a pressure chamber characterized by a liquid level, by at least one inlet for the vapour and liquid mixture coming from the heat exchanger, by at least one outlet for the liquid and by at least one outlet for the vapour. Almost always, the drum is also provided with an inlet for fresh cooling fluid, which is frequently in liquid phase, that replaces at least a portion of the amount of the cooling fluid leaving the drum in vapour state.

According to a common configuration, the drum is internally provided with one or more dividing walls that form at least two sections in the drum, the first for the vapour and liquid mixture and the second for the liquid. The dividing wall is open at the top end. Therefore, the two sections are in communication by the top opening of the dividing wall. The top opening acts as a weir and can also be provided with vapour and liquid separation devices, such as impingement plates or cyclones.

The first section, or the vapour and liquid mixture section, is in communication with the tubes or piping coming from the heat exchanger and therefore the first section receives the vapour and liquid mixture. The second section, or the liquid section, is characterized by a liquid level which is located below the top end of the dividing wall, or the weir, and is in communication with the outlet tubes or piping conveying the liquid towards the heat exchanger or any other equipment. The vapour and liquid mixture discharged into the first section of the drum moves towards the weir. At the weir, where separation devices can be installed for an improved vapour and liquid separation, the vapour and liquid are discharged into the second section. The liquid falls down towards the liquid level, whereas the vapour moves above the liquid level and towards the outlet vapour connection, installed normally at the top of the drum chamber. Additional separation devices can be installed at, or near at, the outlet vapour connection for a fine vapour and liquid separation.

The circulation of the vapour and liquid mixture from the heat exchanger to the drum, and the circulation of the liquid from the drum to the heat exchanger can either occur under natural or forced draft. In case of natural circulation, the drum is installed at an elevated position with regard to the heat exchanger. The vapour and liquid mixture moves upwardly, from the heat exchanger to the drum, and the liquid moves downwardly, from the drum to the heat exchanger, by means of the density difference of upward and downward circuits. The elevation of the drum, with regard to the heat exchanger, represents the static head for the natural circulation.

Many vapour and liquid drums are described in open literature. For example, documents U.S. Pat. Nos. 2,372,992, 2,402,154, 2,420,655, 2,550,066, 2,806,453, 5,061,304, 4,565,554 disclose respective embodiments of drums installed in steam generation units where water-tubes, indirectly receiving heat from the hot fluid and housing the vaporization of the water, are directly connected to the drum. The vaporizing water-tubes discharge the mixture preferably into a steam and water section of the drum, which is separated from the water section of the drum by one or more walls. The mixture is treated by means of separation devices. The separated water is discharged from the steam and water section into the water section of the drum, whereas the separated steam moves to the top of the drum, towards the steam outlet connection. The water section of the drum, characterised by a water level, is connected to large piping, also called downcomers, often installed outside the hot fluid chamber. The downcomers bring the water from the drum towards the bottom of vaporizing tubes or boiler.

In particular, document U.S. Pat. No. 2,372,992 describes a waste heat boiler characterized by an upper and a lower drum connected by vaporizing water-tubes (risers) and downcomers both installed in a casing where a hot flue gas flows. The downcomers, bringing water from the upper drum to the lower drum, have a limited heat transfer with regard to the risers.

Document U.S. Pat. No. 3,114,353 describes a vapour generating unit consisting of a vertical vapour generator of shell-and-tube type, with straight tubes, with upper and lower tube-sheets, with an upper pressure chamber connected to the upper tube-sheet, acting as a vapour and liquid drum, and with a lower pressure chamber connected to the lower tube-sheet, acting as a secondary liquid chamber or liquid drum. The upper chamber, or the vapour and liquid drum, has an internal wall forming two sections, a vapour and liquid section and a liquid section characterized by a liquid level. The vapour and liquid section of the upper drum collects the vapour and liquid mixture directly from the exchanging tubes of the generator. The vapour and liquid section of the upper drum delivers the liquid to the lower liquid drum of the generator by means of a large downcomer, enclosed into the tube bundle, provided with a sleeve for limiting the boiling of the liquid flowing into the downcomer.

In an another configuration, disclosed in document US 2016/0097375, the drum is a pressure chamber connected to the tube-sheet of a shell-and-tube steam generator with exchanging tubes of bayonet type. The steam drum is internally split into two sections by means of a wall. The first section, in communication with one tube pass, collects the steam and water mixture produced in the heat exchanger, whereas the second section, in communication with the other tube pass, acts as a water reservoir and delivers the water to the steam generator tubes. The steam and water mixture is conveyed from the first section of the drum to the separation devices, installed inside the second section of the drum, by piping which is external to the steam drum chamber.

Document U.S. Pat. No. 2,373,564 describes a vertical water-tube waste heat boiler of shell-and-tube type, with two shells connected to a common tubesheet on opposite sides, and with U-tubes connected to the tubesheet. The lower shell houses the tubes and the upper shell serves as water reservoir and steam separating space (drum). The upper shell is provided with a baffle submerged by water present in the upper shell. The upper shell is split into one lower steam-water portion and one upper steam portion, separated by the vapour-liquid interface. The water level in the upper shell is common to both the inlet and outlet ends of the U-tubes.

SUMMARY OF THE INVENTION

The main object of the present invention is therefore to provide an alternative embodiment of a shell-and-tube heat exchanger having a vapour and liquid drum which is capable of:

- collecting the vapour and liquid mixture produced in the heat exchanger tubes;
- providing for the vapour and liquid separation;
- providing for a liquid retention volume;
- delivering the liquid to the heat exchanger tubes
- operating under natural circulation.

This object is achieved according to the present invention by providing a shell-and-tube heat exchanger having a vapour and liquid drum as well as a method of operating a shell-and-tube heat exchanger as set forth in the attached claims.

Specifically, these objects are achieved by a shell-and-tube heat exchanger comprising a shell enclosing a plurality of U-shaped tubes of a tube bundle. Each tube is provided with a first tube portion and with a second tube portion that are hydraulically connected by a U-bend. The open ends of each tube are connected to a tube-sheet and the tubes are vertically arranged and disposed downward with respect to said tube-sheet. The shell is provided with at least an inlet nozzle for inletting a first fluid and with at least an outlet nozzle for outletting the first fluid. A pressure chamber is connected to the tube-sheet on the opposite side of the shell and above said shell. The pressure chamber is provided with a plurality of nozzles for inletting and outletting at least a second fluid. Said second fluid is flowing under natural circulation within the tubes, to indirectly perform a heat exchange with the first fluid, and vaporizing during the heat exchange. The pressure chamber contains a guiding jacket that, at a first end thereof, is sealingly joined to the tube-sheet or the first tube portions and, at a second end thereof that is opposite to the first end, is open. The guiding jacket splits the pressure chamber into a first section, that is enclosed by the guiding jacket and is in communication with the first tube portions, and a second section, that is in communication with the second tube portions. The first section and the second section are in communication with each other by means of the open end of the guiding jacket. The first section has a liquid level, located below said open end, and is provided with a vapour chamber, located above said liquid level. These objects are also achieved by a method of operating a shell-and-tube heat exchanger comprising a shell enclosing a plurality of U-shaped tubes of a tube bundle, wherein each tube is provided with a first tube portion and with a second tube portion that are hydraulically connected by a U-bend, wherein the open ends of each tube are connected to a tube-sheet and the tubes are vertically arranged and disposed downward with respect to said tube-sheet, wherein the shell is provided with at least an inlet nozzle and with at least an outlet nozzle, and wherein a pressure chamber is connected to the tube-sheet on the opposite side of the shell and above said shell, the pressure chamber being provided with a liquid inlet nozzle and a vapour outlet nozzle, wherein the pressure chamber contains a guiding jacket that, at a first end thereof, is sealingly joined to the tube-sheet or the first tube portions and, at a second end thereof that is opposite to the first end, is open, wherein the guiding jacket splits the pressure chamber into a first section, that is enclosed by the guiding jacket and is in communication with the first tube portions, and a second section, that is in communication with the second tube portions, wherein the first section and the second section are in communication with each other by means of the open end of the guiding jacket, and wherein the first section is provided with a vapour chamber. The method comprises:

- inletting a first fluid through the inlet nozzle of the shell,
- inletting a second fluid through the liquid inlet nozzle of the pressure chamber,
- flowing the second fluid within the tubes under natural circulation to indirectly perform a heat exchange with the first fluid and vaporize the second fluid during the heat exchange,
- having a liquid level of the second fluid located below said open end in the first section, above which liquid level the vapour chamber is located,
- outletting the vaporized second fluid through the vapour outlet nozzle of the pressure chamber,
- outletting the first fluid through the outlet nozzle of the shell.

In detail, a preferred embodiment of the vapour and liquid drum for a shell-and-tube heat exchanger according to the present invention is characterized by the following technical features:

- the drum is a pressure chamber connected to the tube-sheet of the shell-and-tube heat exchanger on the opposite side of the exchanger shell;
- the heat exchanger has U-shaped tubes and preferably it is two passes on tube side;
- the heat exchanger has a vertical arrangement, with downward tube bundle;
- the drum is divided in at least two sections, wherein one section is in communication with the first tube pass, whereas the other section is in communication with the second tube pass;

the hot fluid and the cooling fluid flow, respectively, on the shell-side and on the tube-side of the heat exchanger;

the cooling fluid indirectly receives the heat from the hot fluid;

the cooling fluid vaporizes during the heat transfer and flows under natural circulation.

Further characteristics of the invention are underlined by the dependent claims, which are an integral part of the present description.

BRIEF DESCRIPTION OF THE DRAWING

The characteristics and advantages of a vapour and liquid drum for a shell-and-tube heat exchanger according to the present invention will be clearer from the following exemplifying and non-limiting description, with reference to the enclosed schematic drawing, in which FIG. 1 schematically shows a preferred embodiment of a shell-and-tube heat exchanger provided with such a vapour and liquid drum.

DETAILED DESCRIPTION OF THE PREFERRED EMBODIMENTS

With reference to the FIGURE, a shell-and-tube heat exchanger provided with a vapour and liquid drum according to the present invention is shown. The shell-and-tube heat exchanger 10 is provided with a shell 12 enclosing a plurality of U-shaped tubes 14 of a tube bundle. Each tube 14 consists of a first portion or leg 16 and a second portion or leg 18, both hydraulically connected by means of a respective U-bend 20. Both the open ends of each tube 14 are connected to a tube-sheet 22. The tube bundle tubes 14, and thus the heat exchanger 10, have a vertical arrangement, with the tube bundle tubes 14 that are disposed downward with respect to the tube-sheet 22.

A first fluid 24, typically a hot fluid, flows on the shell-side of the heat exchanger 10, entering into the shell 12 and exiting from the shell 12 by at least an inlet nozzle 26 and at least an outlet nozzle 28 respectively. A second fluid, typically a cooling fluid, flows on the tube-side of the heat exchanger 10, i.e. within the tubes 14 of the tube bundle. The heat exchanger 10 thus provides for an indirect heat exchange between the hot fluid and the cooling fluid. The cooling fluid flows under natural circulation and vaporizes during the heat exchange. In a preferred embodiment, the cooling fluid is water and the heat exchanger 10 is a steam generator.

A pressure chamber 30, working as a vapour and liquid drum, is connected to the tube-sheet 22 of the heat exchanger 10 on the opposite side of the shell 12, i.e. on the opposite side of the tube-sheet 22 to the side where the tubes 14 are connected to the tube-sheet 22, and above said shell 12. The drum 30 is provided with a plurality of nozzles 32, 34 and 36 for inletting and outletting the second fluid circulating into said drum 30. The heat exchanger 10 has a two passes configuration on the tube side. The first pass, i.e. the first leg 16 of each tube 14, receives the cooling fluid, substantially in liquid phase, from the drum 30, whereas the second pass, i.e. the second leg 18 of each tube 14, delivers the cooling fluid, as a vapour and liquid mixture, to the drum 30. The second fluid enters into the first tube portion 16 in liquid phase and exits from the second tube portion 18 as a vapour and liquid mixture.

The drum 30 contains a guiding jacket 38 that, at a first end 40 thereof, is sealingly joined to the tube-sheet 22, or to the first legs 16 of the tube bundle tubes 14, and is hydraulically connected to the first legs 16 (first tube pass) of the tube bundle tubes 14. The guiding jacket 38, at a second end 42 thereof that is opposite to the first end 40, is open. The guiding jacket 38 splits the drum 30 into two sections 44 and 46. A first section 44, enclosed by the guiding jacket 38, is in communication with the first legs 16 (first tube pass) of the tube bundle tubes 14, whereas a second section 46 is in communication with the second legs 18 (second tube pass) of the tube bundle tubes 14. The first section 44 and the second section 46 are in communication with each other by means of the open end 42 of the guiding jacket 38. The first section 44 and the second section 46 share a common vapour chamber 50 located above both the first section 44 and the second section 46. The first section 44 is provided with a liquid level 48, located below the open end 42 of the guiding jacket 38, and therefore with a vapour chamber 50, located above the liquid level 48. Second fluid in liquid phase is present in the first section 44 forming a liquid level 48. The second fluid in liquid phase present in the first section 44 forms a reservoir 60 of second fluid having the liquid level 48. Thus, the first section 44 houses a reservoir 60 of the second fluid having the liquid level 48. The reservoir 60 is a liquid reservoir, which means that the reservoir is substantially composed of liquid second fluid, i.e. second fluid in liquid phase. The second fluid in liquid phase partially fills the first section 44, forming a liquid reservoir having the liquid level 48 that preferably is to be controlled for proper operations. Above the liquid level 48 is a vapour chamber 50 formed in the first section 44. The vapour chamber 50 predominantly contains second fluid in vapour phase, but also droplets of liquid second fluid. The liquid level 48 represents the vapour-liquid interface between the liquid reservoir of the first section 44 and the vapour chamber 50. The second section 46 is a vapour-liquid chamber not provided with a specific liquid level, and therefore not provided with a level control. As a result, the liquid reservoir and the associated liquid level are only in direct communication with the first legs 16 and affect the circulation in the tubes 16. An advantage of such a configuration is that the reading and the control of the liquid level 48 are not affected by the rising vapour in the second legs 18 and in the second section 46. The guiding jacket 38 is configured to separate the second fluid into a liquid phase and a vapour phase at the open end 42. The first section 44 is an inner section and the second section 46 is an outer section. The second section 46 is interposed between the guiding jacket 38 and the drum 30. By having the liquid level 48 below the open end 42 of the guiding jacket 38, and conversely, the open end 42 above the liquid level 48, the second fluid is efficiently separated into a liquid phase and a vapour phase at the open end 42. The density difference between the liquid second fluid present in the first section 44 and the vapour-liquid second fluid present in the second section 46 provides for a driving force for the natural circulation within the tubes 14. Further, the liquid second fluid present in the first section 44 provides for a positive static head to perform the natural circulation of the second fluid from the first section 44 to the second section 46 through the tubes 14. This is facilitated by the absence of a pure liquid phase forming a reservoir with a liquid level in the second section.

The drum 30 can also be provided with:

one or more vapour and liquid separation devices 52, installed at, or near at, the open end 42 of the guiding jacket 38;

one or more liquid injection devices 54, configured for injecting liquid preferably into the first section 44 through one or more inlet nozzles 32, which also may be denoted liquid inlet nozzles 32;

one or more liquid extraction devices 56, configured for extracting liquid from the first section 44 through one or more outlet nozzles 34, which also may be denoted liquid outlet nozzles 34;

one or more vapour and liquid separation devices 58, installed at the vapour outlet nozzle 36;

one or more devices (not shown) for measuring and controlling the liquid level (48).

Ideally, the layout of the tube bundle tubes 14 is of concentric type, that is the first legs 16 (first tube pass) of the tube bundle tubes 14 are arranged in a circular central zone of the tube-sheet 22, whereas the second legs 18 (second tube pass) of the tube bundle tubes 14 are arranged in an annular region surrounding the first legs 16. According to such ideal tube bundle arrangement, the guiding jacket 38 is concentrically arranged in the drum 30 and the second section 46 surrounds the first section 44.

Fresh cooling fluid is injected preferably into the first section 44 from the inlet nozzle 32, by means of the liquid injection devices 54. The injection occurs at a location below the open end 42 of the guiding jacket 38, preferably below the liquid level 48, so that the fresh cooling fluid mixes with the cooling liquid already present in the first section 44. The liquid in the first section 44 falls into the first legs 16 (first tube pass) of the tube bundle tubes 14 and moves downwardly under natural circulation. Along the U-shaped tubes 14 an indirect heat exchange occurs from the hot fluid 24 flowing on the shell-side to the cooling fluid. The cooling fluid vaporizes. The vapour and liquid mixture moves upwardly in the second legs 18 (second tube pass) of the tube bundle tubes 14, under natural circulation, and is discharged into the second section 46. The second fluid flows under natural circulation within the tubes 14 by entering into the first tube portion 16 in liquid phase and exiting from the second tube portion 18 as a vapour and liquid mixture. The mixture in the second section 46 moves upward by natural circulation till to the open end 42 of the guiding jacket 38. The open end 42, which can be provided with vapour and liquid separation devices 52 for improving the separation, acts as a weir for the mixture. The vapour and liquid are discharged into the first section 44, and specifically the liquid falls down towards the liquid level 48, whereas the vapour moves in the vapour chamber 50 towards the vapour outlet nozzle 36. The vapour can be further purified from liquid droplets by means of the additional vapour and liquid separation devices 58 installed at, or near at, the vapour outlet nozzle 36.

The first section 44 of the drum 30 is also provided with liquid extraction devices 56 for removal of a portion of liquid (blow-down) from the respective nozzle 34. The blow-down is often necessary for keeping at a proper level the contaminants concentration, which tends to increase due to natural circulation between the drum 30 and the tube bundle tubes 14. In steady-state operating conditions, the amount of the leaving vapour and blow-down corresponds to the total amount of the fresh cooling fluid injected into the drum 30.

The first section 44 of the drum 30 is also provided with necessary instrumentation for monitoring and controlling the liquid level 48. The natural circulation between the drum 30 and the tube bundle tubes 14 depends on the static head given by the liquid level 48, on the density difference between the liquid flowing downwardly and the vapour and liquid mixture flowing upwardly, and on the overall pressure drops of the circuit. The liquid reservoir in the first section 44 is also a liquid reservoir for the heat exchanger 10, providing for necessary liquid retention volume in case of disturbed operating conditions or shut-downs.

According to one aspect, the present invention relates to a method of operating a shell-and-tube heat exchanger 10 comprising a shell 12 enclosing a plurality of U-shaped tubes 14 of a tube bundle, wherein each tube 14 is provided with a first tube portion 16 and with a second tube portion 18 that are hydraulically connected by a U-bend 20, wherein the open ends of each tube 14 are connected to a tube-sheet 22 and the tubes 14 are vertically arranged and disposed downward with respect to said tube-sheet 22, wherein the shell 12 is provided with at least an inlet nozzle 26 and with at least an outlet nozzle 28, and wherein a pressure chamber 30 is connected to the tube-sheet 22 on the opposite side of the shell 12 and above said shell 12, the pressure chamber 30 being provided with a liquid inlet nozzle 32 and a vapour outlet nozzle 36, wherein the pressure chamber 30 contains a guiding jacket 38 that, at a first end 40 thereof, is sealingly joined to the tube-sheet 22 or the first tube portions 16 and, at a second end 42 thereof that is opposite to the first end 40, is open, wherein the guiding jacket 38 splits the pressure chamber 30 into a first section 44, that is enclosed by the guiding jacket 38 and is in communication with the first tube portions 16, and a second section 46, that is in communication with the second tube portions 18, wherein the first section 44 and the second section 46 are in communication with each other by means of the open end 42 of the guiding jacket 38, and wherein the first section 44 is provided with a vapour chamber 50, the method comprising:

inletting a first fluid 24 through the inlet nozzle 26 of the shell 12, inletting a second fluid through the liquid inlet nozzle 32 of the pressure chamber 30, flowing the second fluid within the tubes 14 under natural circulation to indirectly perform a heat exchange with the first fluid 24 and vaporize the second fluid during the heat exchange, having a liquid level 48 of the second fluid located below said open end 42 in the first section 44, above which liquid level 48 the vapour chamber 50 is located, outletting the vaporized second fluid through the vapour outlet nozzle 36 of the pressure chamber 30, outletting the first fluid 24 through the outlet nozzle 28 of the shell 12.

Having a liquid level 48 of the second fluid located below said open end 42 in the first section 44 may alternatively be formulated as keeping the liquid level 48 of the second fluid below said open end 42 in the first section 44. Having or keeping a liquid level 48 of the second fluid located below said open end 42 in the first section 44 may be performed by outletting second fluid through a liquid outlet nozzle 34 of the pressure chamber 30. Having or keeping a liquid level 48 of the second fluid located below said open end 42 in the first section 44 may be performed by inletting second fluid through a liquid inlet nozzle 32 of the pressure chamber 30. Having or keeping a liquid level 48 of the second fluid located below said open end 42 in the first section 44 may be performed by controlling the liquid level 48 by means of suitable level instruments (not shown), by outletting second fluid through the liquid outlet nozzle 34 and/or by inletting second fluid through the liquid inlet nozzle 32. The second fluid is substantially liquid when had or kept at a liquid level below the open end as well as when outlet through the liquid outlet nozzle 34.

The method may comprise any or all of the below steps, which from a pedagogic standpoint are to be performed in the presented order, but in practice the method is a continuous process:

Inletting (or discharging) the second fluid into the first section 44 through the liquid inlet nozzle 32. The second fluid is substantially liquid, i.e. substantially in liquid phase, when inlet (or discharged) into the first section 44.

Obtaining a reservoir 60 of the second fluid having the liquid level 48 in the first section 44. The reservoir 60 is housed in the first section 44.

Flowing the second fluid within the tubes 14 under natural circulation. This may be performed by discharging the second fluid from the first section 44 into the first tube portion 16. The second fluid is substantially liquid, i.e. substantially in liquid phase, when introduced into the first tube portion 16.

Subjecting the second fluid to indirect heat exchange with the first fluid along the tubes 14. Thereby, the second fluid is vaporized forming a vapour and liquid mixture of the second fluid.

Discharging the vapour and liquid mixture of the second fluid from the tubes 14, more specifically from the second tube portion 16, into the second section 46.

Discharging the vapour and liquid mixture of the second fluid into the first section 44. Thereby a liquid portion of the second fluid, more specifically of the vapour and liquid mixture of the second fluid, falls down towards the liquid level 48 and a vapour portion of the second fluid moves into the vapour chamber 50. The vapour and liquid mixture of the second fluid is discharged from the second section 46 into the first section 44. The vapour and liquid mixture of the second fluid is discharged into the first section 44 at the open end 42 of the guiding jacket 38. The liquid portion falls down into the reservoir 60 of the second fluid.

Outletting the vaporized second fluid through the vapour outlet nozzle 36 of the pressure chamber 30. In particular, the vapour portion of the second fluid is outlet through the vapour outlet nozzle 36. The vapour portion predominantly contains second fluid in vapour phase, but may also contain droplets of liquid second fluid.

The shell-and-tube heat exchanger of the method may be a shell-and-tube heat exchanger as defined above and may include any of the features, versions and embodiments described above. For example, the guiding jacket 38 may be concentrically arranged in the pressure chamber 30 and the second section 46 surround the first section 44. Further, the layout of the tube bundle tubes 14 may be of concentric type, that is the first tube portions 16 are arranged in a circular central zone of the tube-sheet 22, whereas the second tube portions 18 are arranged in an annular region surrounding said first tube portions 16.

It is thus seen that the shell-and-tube heat exchanger having a vapour and liquid drum as well as the method of operating a shell-and-tube heat exchanger according to the present invention achieves the previously outlined object.

The shell-and-tube heat exchanger having a vapour and liquid drum as well as the method of the present invention thus conceived is susceptible in any case of numerous modifications and variants, all falling within the same inventive concept; in addition, all the details can be substituted by technically equivalent elements. In practice, the materials used, as well as the shapes and size, can be of any type according to the technical requirements.

The scope of protection of the invention is therefore defined by the enclosed claims.

The invention claimed is:

1. Shell-and-tube heat exchanger comprising a shell enclosing a plurality of U-shaped tubes of a tube bundle, wherein each tube includes first and second open ends and is provided with a first tube portion and with a second tube portion that are hydraulically connected by a U-bend, wherein the first and second open ends of each tube are connected to a tube-sheet and the tubes are vertically arranged and disposed downward with respect to said tube-sheet, wherein the shell is provided with at least an inlet nozzle for inletting a first fluid and with at least an outlet nozzle for outletting the first fluid, and wherein a pressure chamber is connected to the tube-sheet on the opposite side of the shell and above said shell, the pressure chamber being provided with a plurality of nozzles for inletting and outletting a second fluid, said second fluid flowing under natural circulation within the tubes, to indirectly perform a heat exchange with the first fluid, and vaporizing during the heat exchange, wherein the pressure chamber contains a guiding jacket that, at a first end thereof, is sealingly joined to the tube-sheet or the first tube portions and, at a second end thereof that is opposite to the first end, is open, wherein the guiding jacket splits the pressure chamber into a first section and a second section, the first section of the pressure chamber being enclosed by the guiding jacket and being in communication with the first tube portions by way of the first open ends of the tubes so that the second fluid introduced into the first section of the pressure chamber flows through the first open ends of the tubes and into the first tube portions, the second section of the pressure chamber being in communication with the second tube portions by way of the second open ends, wherein the second open ends open directly into the second section of the pressure chamber so that the second fluid in the second tube portions flows directly into the second section of the pressure chamber by way of the second open ends, wherein the first section and the second section are in communication with each other by way of the open end of the guiding jacket, and wherein the first section has a liquid level, located below said open end, and is provided with a vapour chamber, located above said liquid level.

2. Shell-and-tube heat exchanger according to claim 1, wherein the first section houses a reservoir of the second fluid having the liquid level.

3. Shell-and-tube heat exchanger according to claim 1, wherein the shell-and-tube heat exchanger has a two passes configuration in which the first tube portions receive the second fluid in liquid phase from the pressure chamber, whereas the second tube portions deliver the second fluid, as a vapour and liquid mixture, to the pressure chamber.

4. Shell-and-tube heat exchanger according to claim 1, wherein the pressure chamber is provided with one or more vapour and liquid separation devices installed at, or adjacent, the open end of the guiding jacket.

5. Shell-and-tube heat exchanger according to claim 1, wherein the pressure chamber is provided with one or more liquid injection devices, configured for injecting liquid into the pressure chamber through one or more liquid inlet nozzles.

6. Shell-and-tube heat exchanger according to claim 1, wherein the pressure chamber is provided with one or more liquid extraction devices, configured for extracting liquid from the first section through one or more liquid outlet nozzles.

7. Shell-and-tube heat exchanger according to claim 1, wherein the pressure chamber is provided with one or more vapour and liquid separation devices installed at a vapour outlet nozzle of the pressure chamber.

8. Shell-and-tube heat exchanger according to claim 1, wherein the layout of the tube bundle tubes is of concentric type, wherein the first tube portions are arranged in a circular central zone of the tube-sheet, and wherein the second tube portions are arranged in an annular region surrounding said first tube portions.

9. Shell-and-tube heat exchanger according to claim 1, wherein the guiding jacket is concentrically arranged in the pressure chamber and the second section surrounds the first section.

10. Shell-and-tube heat exchanger according to claim 1, wherein said first fluid flowing into the shell is a hot fluid, whereas said second fluid flowing into said pressure chamber and said U-shaped tubes is a cooling fluid.

11. Shell-and-tube heat exchanger according to claim 1, wherein the second fluid is water and the shell-and-tube heat exchanger is a steam generator.

12. Method of operating a shell-and-tube heat exchanger comprising a shell enclosing a plurality of U-shaped tubes of a tube bundle, wherein each tube includes open first and second ends and is provided with a first tube portion and with a second tube portion that are hydraulically connected by a U-bend, wherein the open ends of each tube are connected to a tube-sheet and the tubes are vertically arranged and disposed downward with respect to said tube-sheet, wherein the shell is provided with an inlet nozzle and with an outlet nozzle, and wherein a pressure chamber is connected to the tube-sheet on the opposite side of the shell and above said shell, the pressure chamber being provided with a liquid inlet nozzle and a vapour outlet nozzle, wherein the pressure chamber contains a guiding jacket that, at a first end thereof, is sealingly joined to the tube-sheet or the first tube portions and, at a second end thereof that is opposite to the first end, is open, wherein the guiding jacket splits the pressure chamber into a first section, that is enclosed by the guiding jacket and is in communication with the first tube portions, and a second section, that is in communication with the second tube portions, wherein the first section and the second section are in communication with each other by way of the open end of the guiding jacket, and wherein the first section is provided with a vapour chamber, the method comprising:

inletting a first fluid through the inlet nozzle of the shell, inletting a second fluid through the liquid inlet nozzle of the pressure chamber, introducing the second fluid in the first section of the pressure chamber into the open first ends of the tubes, flowing the second fluid within the tubes under natural circulation to indirectly perform a heat exchange with the first fluid and vaporize the second fluid during the heat exchange, discharging the second fluid from the open second ends of the tubes so that the second fluid enters the second section of the pressure chamber, and flowing the second fluid that has entered the second section of the pressure chamber toward the open second end of the guiding jacket so the second fluid enters the first section of the pressure chamber by way of the open second end of the guiding jacket, wherein the second fluid that is discharged from the open second ends of the tubes passes through the second section of the pressure chamber before entering the first section of the pressure chamber, having a liquid level of the second fluid located below said open end in the first section to separate the vaporized second fluid from a liquid portion of the second fluid at the open end, the vapour chamber being located above the liquid level, outletting the vaporized second fluid through the vapour outlet nozzle of the pressure chamber, and outletting the first fluid through the outlet nozzle of the shell.

13. Method according to claim 12, wherein the liquid portion of the second fluid that enters the first section of the pressure chamber by way of the open second end of the guiding jacket falls down towards the liquid level and the vaporized second fluid moves into the vapour chamber.

14. Method according to claim 12, wherein the second fluid is inlet into the first section.

15. Method according to claim 12, comprising obtaining a reservoir of the second fluid having the liquid level in the first section.

16. Method according to claim 12, wherein the vaporized second fluid is separated from the liquid portion of the second fluid at the open end so that the liquid portion that has been separated from the vaporized second fluid flows into the first section, the separating of the second fluid into the liquid portion and the vaporized second fluid occurring after the flowing of the second fluid upwardly from the lower portion of the second section of the pressure chamber toward the open end of the guiding jacket.

17. Method according to claim 12, wherein the liquid portion of the second fluid flows into the first section, the liquid portion of the second fluid present in the first section contributing to providing a positive static head that performs the natural circulation of the second fluid from the first section to the second section by way of the tubes.

18. Shell-and-tube heat exchanger comprising a shell enclosing a plurality of U-shaped tubes of a tube bundle, wherein each tube is provided with a first tube portion and with a second tube portion that are hydraulically connected by a U-bend, wherein open first and second ends of each tube are connected to a tube-sheet and the tubes are vertically arranged and disposed downward with respect to said tube-sheet, wherein the shell is provided with at least an inlet nozzle for inletting a first fluid and with at least an outlet nozzle for outletting the first fluid, and wherein a pressure chamber is connected to the tube-sheet on the opposite side of the shell and above said shell, the pressure chamber being provided with a plurality of nozzles for inletting and outletting a second fluid, said second fluid flowing under natural circulation within the tubes, to indirectly perform a heat exchange with the first fluid, and vaporizing during the heat exchange, wherein the pressure chamber contains a guiding jacket having opposite ends, the opposite ends being a lower end and an upper end, the lower end of the guiding jacket being sealingly joined to the tube-sheet or the first tube portions, the upper end of the guiding jacket being an open upper end, wherein the guiding jacket splits the pressure chamber into a first section and a second section, the first section of the pressure chamber being enclosed by the guiding jacket and being in communication with the first tube portions so that the second fluid in a lower portion of the first section flows into the first tube portions of the tubes by way of the open first ends of the tubes and is subject to the heat exchange in the tubes, the second section of the pressure chamber including a lower portion that is in communication with the open second ends of the tubes so that the second fluid in the second tube portions enters the lower portion of the second section of the pressure chamber by way of the open second ends of the tubes and flows upwardly in the second section toward the open upper end of the guiding jacket, the first section and the second section communicating with each other by way of the open upper end of the guiding jacket, whereby the second fluid is separated into a liquid phase and a vapor phase at the open upper end and the liquid phase that has been separated from the vapor phase flows into the first section, the guiding jacket being positioned between the open first ends of the tubes and the open second ends of the tubes so that the second fluid entering the lower portion of the second section of the pressure chamber by way of the open second ends of the tubes is separated from the first section of the pressure chamber and is only able to flow into the first section of the pressure chamber after flowing upwardly in the second section and passing the open upper end of the guiding jacket.

19. Shell-and-tube heat exchanger according to claim 18, wherein the first section is configured to hold the second fluid in a liquid state to constitute a reservoir of liquid that is in direct communication with only the first tube portions, an upper surface of the reservoir of liquid defining a liquid level.

* * * * *